US010328745B2

(12) United States Patent
John et al.

(10) Patent No.: US 10,328,745 B2
(45) Date of Patent: Jun. 25, 2019

(54) ARTIST'S TOTE

(71) Applicant: Be ArtSmart, L.L.C., Greensboro, NC (US)

(72) Inventors: Charles D. John, Greensboro, NC (US); Richard W. Chatham, Greensboro, NC (US)

(73) Assignee: Be ArtSmart, L.L.C., Greensboro, NC (US)

( * ) Notice: Subject to any disclaimer, the term of this patent is extended or adjusted under 35 U.S.C. 154(b) by 221 days.

(21) Appl. No.: 15/518,376

(22) PCT Filed: Oct. 14, 2015

(86) PCT No.: PCT/US2015/055524

§ 371 (c)(1),
(2) Date: Apr. 11, 2017

(87) PCT Pub. No.: WO2016/061221

PCT Pub. Date: Apr. 21, 2016

(65) Prior Publication Data

US 2017/0305187 A1 Oct. 26, 2017

Related U.S. Application Data

(60) Provisional application No. 62/064,004, filed on Oct. 15, 2014.

(51) Int. Cl.
*B44D 3/04* (2006.01)
*A45C 3/00* (2006.01)
(Continued)

(52) U.S. Cl.
CPC ..... *B44D 3/04* (2013.01); *A45C 3/004* (2013.01); *B05C 17/00* (2013.01); *B44D 3/00* (2013.01)

(58) Field of Classification Search
CPC ..... A45C 3/004; B05C 17/00; B44D 3/00; B44D 3/02; B44D 3/04
(Continued)

(56) References Cited

U.S. PATENT DOCUMENTS 1,212,188 A 1/1917 Couper
3,168,363 A 2/1965 Monsour
(Continued)

OTHER PUBLICATIONS

White PVC 4 Compartment Flat Bin with Acrylic Lid, TrippNT Products, https://web.archive.org/web/20140720013440/http://www.trippnt.com/Covered-4-Bin-Sorter-Storage-p/50458.htm, Jul. 20, 2014, 2 pgs.

(Continued)

*Primary Examiner* — James N Smalley
*Assistant Examiner* — Madison L Poos
(74) *Attorney, Agent, or Firm* — Womble Bond Dickinson (US) LLP

(57) ABSTRACT

An artist's container having a bottom wall and a peripheral wall of non-uniform height surrounding the bottom wall. The peripheral wall defines a footprint of the container when viewed from the top. The container includes one or more interior walls positioned within the footprint of the container to divide the interior into a plurality of storage compartments. The container also includes a plurality of support posts. The plurality of support posts extend to varied heights above the bottom wall such that an imaginary support plane is collectively defined by the tops of the plurality of support posts. The support plane is inclined relative to the bottom wall and is configured to support an artist's palette near the edges of the palette.

20 Claims, 12 Drawing Sheets

(51) Int. Cl.
*B05C 17/00* (2006.01)
*B44D 3/00* (2006.01)

(58) Field of Classification Search
USPC ..... 206/1.7, 1.8, 575; 220/505, 535
See application file for complete search history.

(56) References Cited

U.S. PATENT DOCUMENTS

| | | | | | |
|---|---|---|---|---|---|
| 3,280,966 | A * | 10/1966 | Boniface | B44D 3/02 206/1.7 |
| 3,576,252 | A | 4/1971 | Connolly | |
| 3,650,589 | A | 3/1972 | Linger | |
| 5,257,721 | A | 11/1993 | Smith et al. | |
| 5,738,241 | A * | 4/1998 | McEntee | B25H 3/02 206/373 |
| 5,882,097 | A | 3/1999 | Kohagen et al. | |
| 6,206,183 | B1 * | 3/2001 | Helsel | A47B 97/08 206/1.7 |
| 6,619,474 | B2 | 9/2003 | Montgomery | |
| 2009/0321282 | A1 | 12/2009 | Asmaro | |

OTHER PUBLICATIONS

Artist's Paint Box with Palette, Plazaart, www.plazaart.com, known at least as early as Oct. 14, 2014, 2 pgs.
M.M. Large Elm Brush/Paint Box w/ palette, House of Arts, www.house-of-arts.co.za, known at least as early as Oct. 14, 2014, 2 pgs.
International Search Report for PCT/US2015/055524, dated Jan. 11, 2016, 6 pgs.

* cited by examiner

ARTIST'S TOTE

PRIORITY

The present application is a 371 National Filing of PCT/US2015/055524, filed Oct. 14, 2015, which claims priority to U.S. Provisional application 62/064,004 filed Oct. 15, 2014.

FIELD OF INVENTION

The present disclosure relates to a container configured to hold brushes, paint tubes and other materials and implements especially for use by artists. This disclosure also relates to a combination of the container with one or more of the artist's materials or implements.

BACKGROUND

Artists, especially painters, rely upon a large variety of tools and materials to perform their craft. The volume of products and equipment necessary for a fully-prepared artist can be hard to organize and even more difficult to transport when the artist desires to move outside their usual studio, to attend a class, or to travel to the subject being painted.

The materials commonly used by painters can encompass a variety of sizes and shapes. Materials can vary from large jars of water, top-heavy tubes of paint in a variety of sizes, oil jars, slender charcoal sticks and rolls of tape.

The equipment used by painters also can encompass a variety of shapes and sizes. From long, thin brushes and rulers, to wide sponges, broad palettes, palette knives, paint erasers, as well as rags or paper towel to dry brushes.

Several briefcase-style boxes are found within the prior art that include compartmentalized enclosures that may or may not allow for the inclusion of an artist's palette. For example, U.S. Pat. No. 5,257,721 describes a painter's box with the lower half divided into a plurality of compartments positioned below a rectangular palette.

SUMMARY

However, while the '721 patent addresses some of the artist's needs, there is a need for a more functional receptacle configured to hold the materials and equipment used by artists and painters in a more user friendly manner. The receptacle should allow for organization and transportation of tools in a highly functional manner to enhance the artistic experience by placing the necessary tools at the artist's fingertips and the palette at a more user friendly angle. At the same time, the items frequently used, should not be covered by the palette.

The present disclosure relates to an artist's container configured to organize and store the materials and equipment most often used by painters. Particularly, artist's containers according to embodiments of the present disclosure are specifically configured to removably hold an artist's palette, in a sloped orientation, for use on or off the container.

In some embodiments, the container includes posts to support the weight of the palette and walls configured to maintain the position of the palette. In some embodiments, the walls do not completely surround the palette when it rests upon the posts. In some embodiments, the palette extends beyond the footprint of the container when the palette is properly seated on the container. In other embodiments, the palette, when resting on the support posts, lies substantially entirely within the footprint of the container.

In some embodiments of the present disclosure the container is configured to store the artist's equipment and materials in an organized manner. The container is configured to hold a palette that may form a lid for at least a portion of the container. The palette may have markings to indicate proper orientation of the palette for placement within the container.

DETAILED DESCRIPTION

The following description sets forth a further discussion of the figures accompanying this application. The combination of the several views will allow one skilled in the art to fully appreciate at least one embodiment of the artist's container as described below, including features and advantages beyond those expressly called out in this section. In other words, the figures are fully supportive of all that they show and enable to one of ordinary skill in the art, above and beyond any features discussed in this description.

Figure 1:
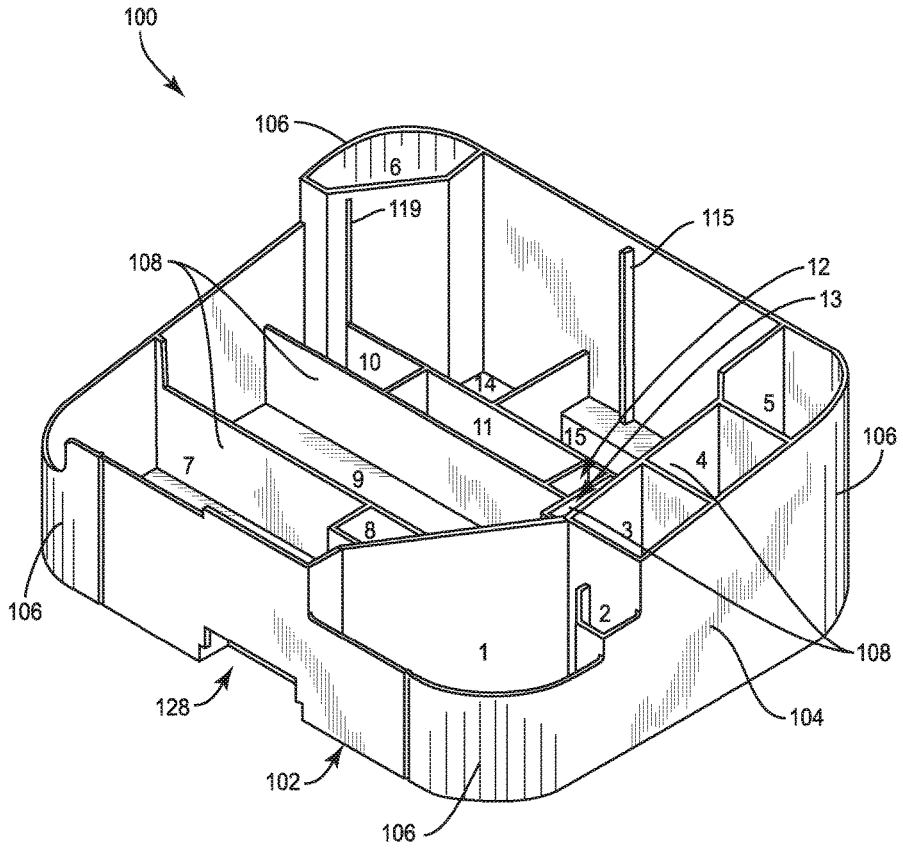
FIG. 1 shows a perspective view of a container according to embodiments of the present disclosure.
Figure 1A:
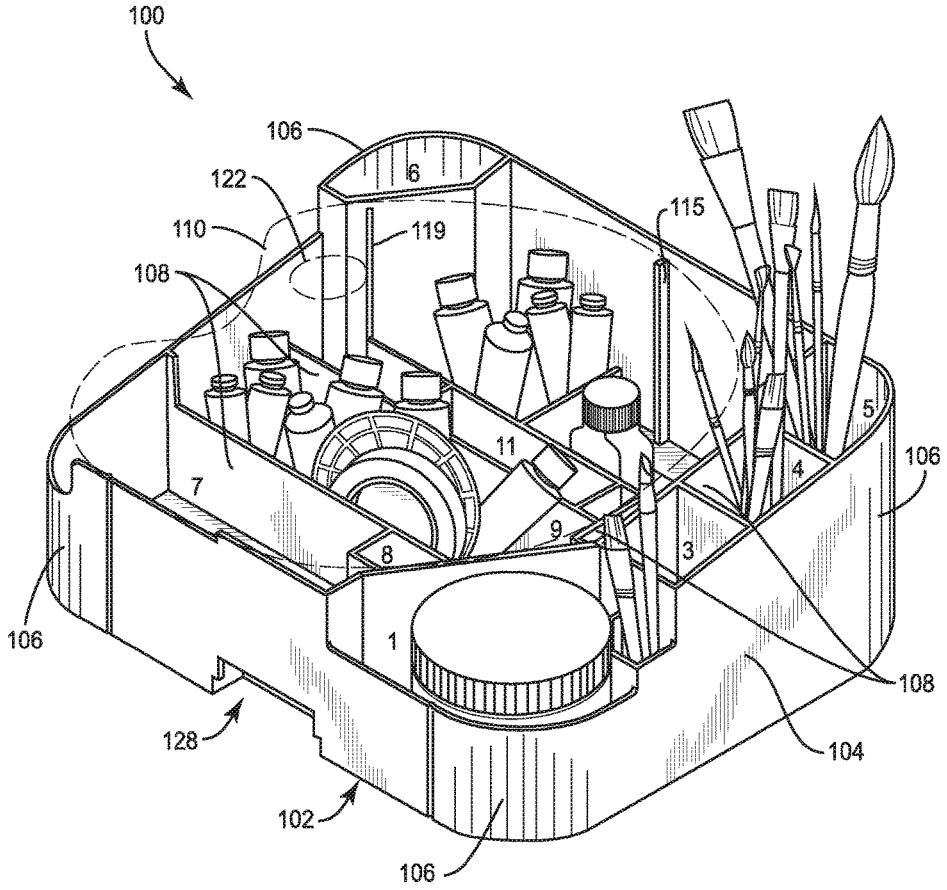
FIG. 1A shows a perspective view of the container with representative stored items therein.
Figure 2:
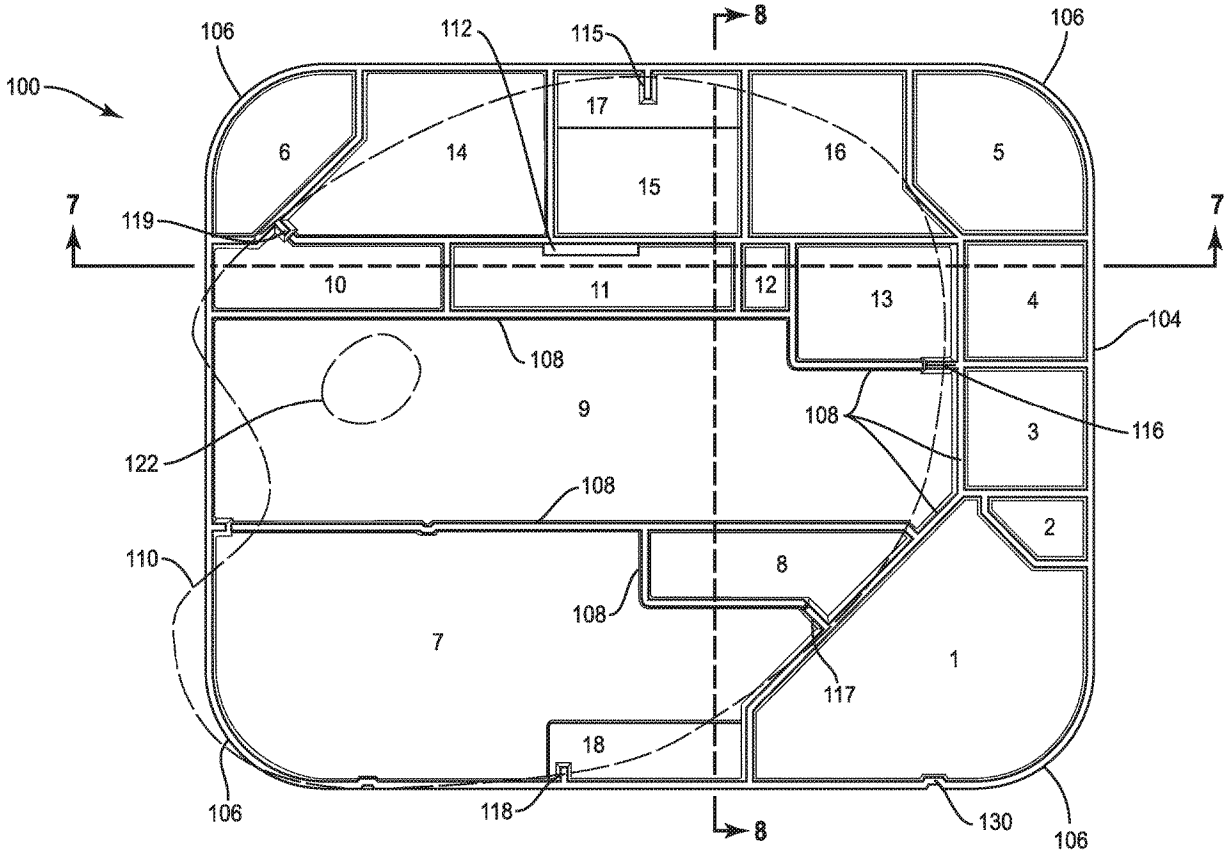
FIG. 2 shows a top view of the container shown in FIG. 1.
Figure 3:
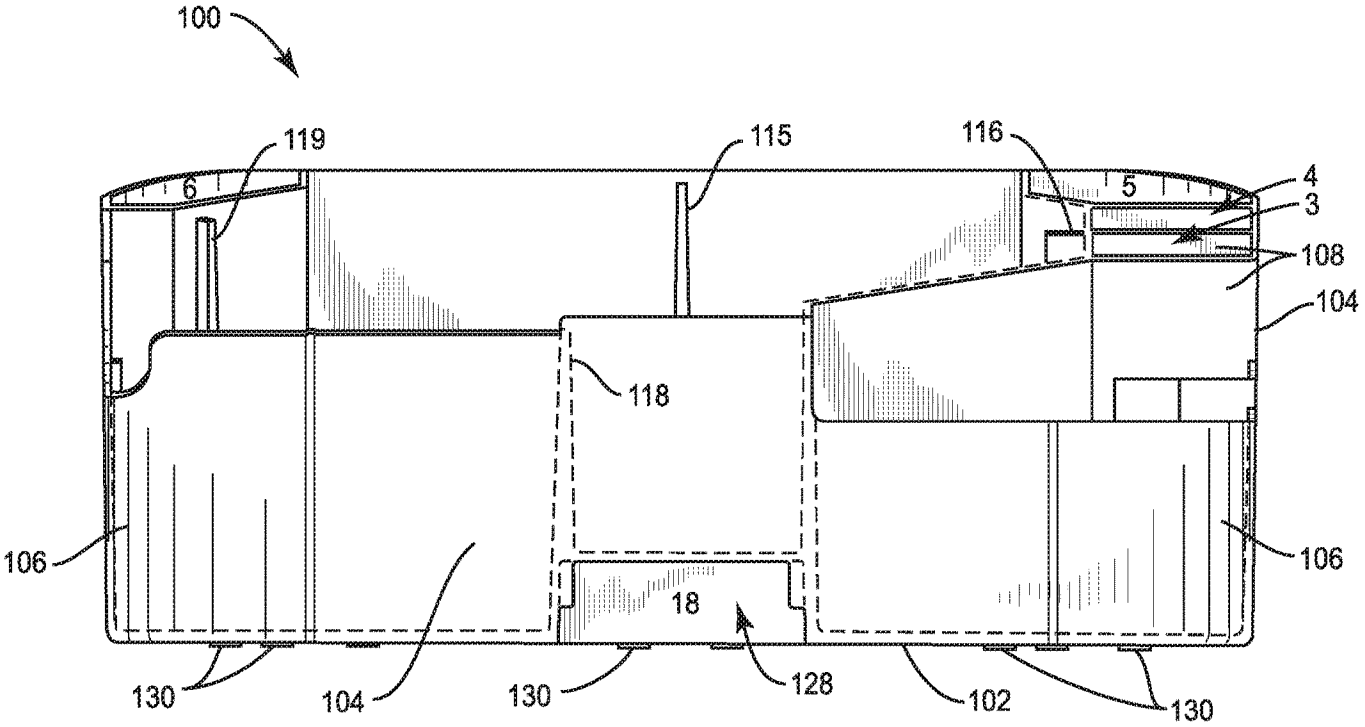
FIG. 3 shows a front view of the container shown in FIG. 1.

Turning to FIGS. 1 and 2, the present disclosure relates to a container 100 for use by artists with respect to the storage, organization and transportation of the items most commonly used in the field. The container 100 may be particularly useful for painters. Painters may require a variety of consumable materials, the most obvious being paint. Other materials may include oils, water, tape, etc. Painters may require a variety of generally durable tools and equipment, such as brushes, knives, erasers, rulers and sponges. FIG. 1A shows the container 100 with exemplary tools and equipment therein, and a typical palette thereon in dashed lines.

Figure 4:
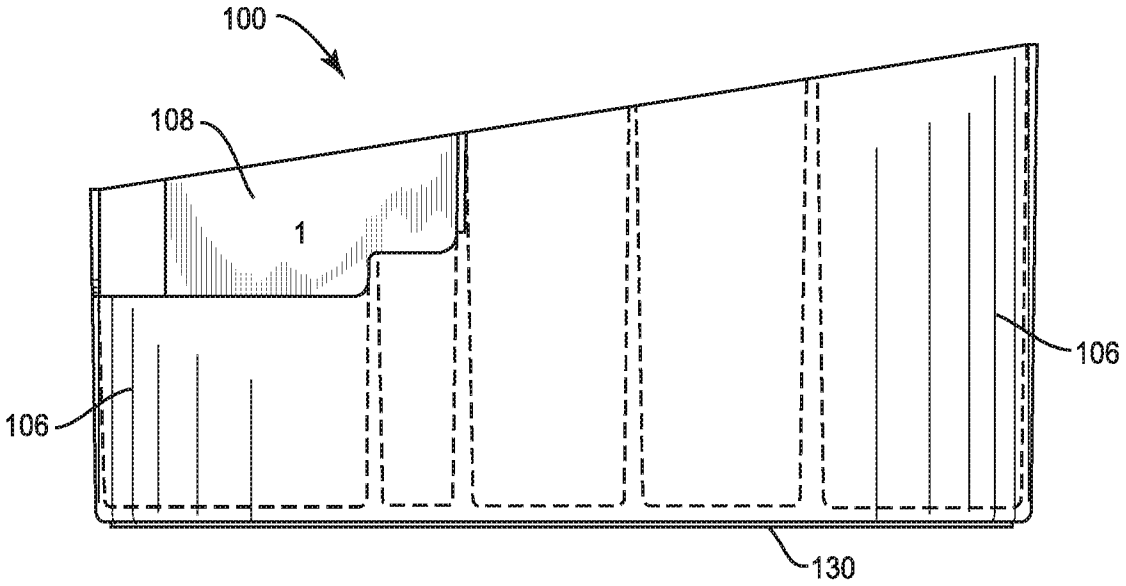
FIG. 4 shows a right side view of the container shown in FIG. 1.

The container 100 of the present disclosure includes a bottom wall 102 that may be adapted to rest on a surface, such as a desk or a table. The bottom wall 102 may include one or more rubber pads for limiting sliding of the container 100 relative to the surface or to help avoid damage to the container or the surface when the container rests upon the surface. The container 100 may have a peripheral wall 104 extending upward relative to the bottom wall 102. The peripheral wall 104 can have a non-uniform wall height H (FIG. 4) that varies relative to the bottom wall 102, or the surface on which the container is resting. In other words, with the bottom wall 102 defines a reference plane. Different portions of the peripheral wall 104 extend to different heights above the reference plane for reasons to be later explained.

The peripheral wall 104 generally defines a footprint of the container 100 and the outermost bounds of a storage cavity of the container 100, as viewed from the top plan view seen in FIG. 2. The footprint of the container 100 should be so dimensioned to provide sufficient capacity for storage and transportation of materials and tools, but not be so large as to hinder the ability for the artist to comfortably transport the container 100 or rest the container on available surface space. In one embodiment, the footprint may be approximately 13 inches by approximately 16 inches. While there is no specific upper limit to the size of the footprint, a footprint having a maximum length of about 21 inches or less is preferred.

As seen in the figures, the peripheral wall 104 may form a footprint having a generally rectangular shape. The rectangular footprint may have rounded corners 106. The rounded corners 106 may provide more pleasing aesthetics, more convenience, a reduction in sharp edges, and may be better able to hold rounded or cylindrical objects, such as jars, along the rounded portions of the peripheral wall 104.

The container 100 includes a plurality of interior walls 108 formed, or removably inserted, within the peripheral wall 104 to create a plurality of distinct storage compartments (labeled 1-16). The storage compartments 1-16 have a variety of lengths, widths and depths. The variety of dimensions allows the artist to store their materials and tools in an organized and easily accessed manner by positioning each item within an appropriately sized one or more of the storage compartments 1-16.

In a non-limiting example, Table 1 lists sample materials and tools approximately suitable for each compartment.

TABLE 1

| Compartment | Suitable stored item |
|---|---|
| 1 | Brush wash jar and linseed oil adapter |
| 2 | Paint eraser |
| 3 | Paint brushes |
| 4 | Paint brushes |
| 5 | Paint brushes and miscellaneous |
| 6 | Palette knives |
| 7 | Large white paint tube and miscellaneous |
| 8 | Sponge and spring load clip |
| 9 | Large paint brushes and rules |
| 10 | Small paint tubes |
| 11 | Color wheel and roll of masking tape |
| 12 | Compressed charcoal sticks |
| 13 | Linseed oil jar |
| 14 | Paint tubes |
| 15 | Paint tubes |
| 16 | Paint tubes |

The illustrated number and layout of storage compartments 1-16, with the proposed use of each compartment, has been found to provide a generally weight-balanced container when loaded with a typical amount of the proposed materials and tools.

Compartment 2 may store paint erasers in a generally vertically elongated compartment.

Compartments 3-6 may store paint brushes, palette knives or other generally long, thin items in a vertical fashion in such a manner as to be accessible to the artist when the palette is resting on the container 100. Compartments 3-6 may be suitable for holding long items, because these compartments 3-6 have the greatest depth due to the relatively tall portions of the peripheral wall 104 and relatively tall interior walls 108.

Figure 11:
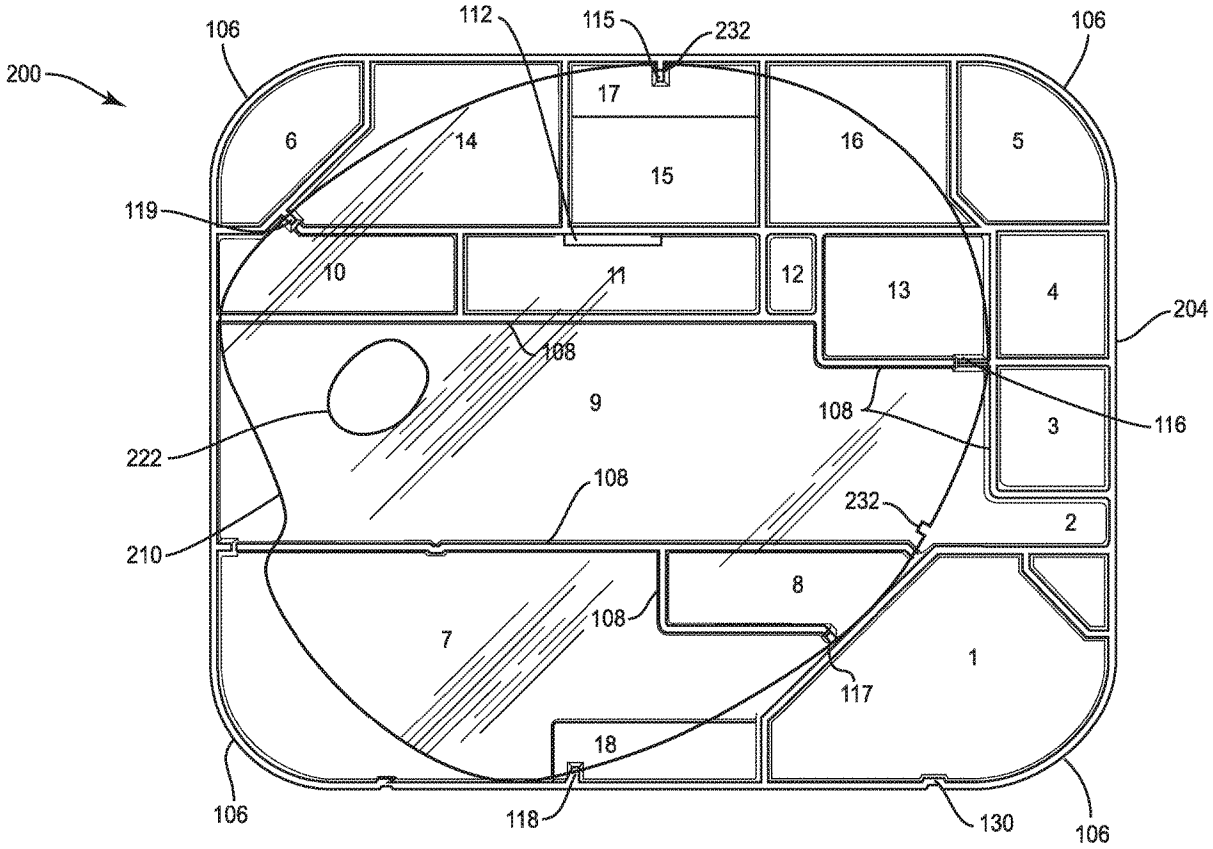
FIG. 11 shows a top view of the container shown in FIG. 10.

Compartments 7-9 may store a variety of items in a generally horizontal fashion. For example, compartment 8 may hold a sponge, and compartment 9 may be of sufficient length to accommodate a standard 12-inch ruler. When transporting the container 100, longer items, such as brushes, may be removed from compartments 3-6 and laid within compartment 9. In one embodiment, see FIG. 11, compartment 9 extends the full width of the container 200 to maximize the length of brushes which may lie in the container 200, such as a 15 inch long brush. By removing the items extending from compartments 3-6 during transportation, a cover, such as palette 110 (FIG. 2) may be provided snugly over the top of the container 100.

Compartments 10-13 are all of smaller dimensions to hold various smaller material or equipment items such as oil jars, small charcoal sticks, rolls of tape, etc. In one embodiment, the bottom of one of the compartments (e.g. compartment 11) may have a small groove 112 (FIG. 2) formed in the upper surface of the bottom wall 102 to position and support a color wheel in an upright fashion.

Compartments 14-16 are useful for holding paint tubes. Particularly, applicants have found that the color within each paint tube can be most easily identified, and the tubes accessed, when stored in an upright position. Therefore, it has been found to be beneficial to include one or more storage compartments, in this case compartments 14-16, having each dimension less than about 5.75 inches and greater than about 1.75 inches to accommodate one or more tubes of paint only in an upright position. The designated compartment should not be deeper than the paint tube at full length.

One commonly used piece of equipment is the painter's palette 110 (see FIGS. 1A and 2). The container 100 of the present disclosure has been specifically created with the placement of a palette 110 in mind. Palettes 110 are most commonly available in two basic shapes: rectangular and oval. These basic shapes may be modified with various finger holes, cutouts, or indentions for convenience of the user. Palettes are also available in a variety of sizes.

The container 100 has at least one dimension specifically selected so that the container is able to securely support a palette 110 of predetermined size and shape. In the illustrated embodiment of FIGS. 1-9, several dimensions have been specifically selected, within reasonable tolerances, such that the container 100 will securely support a generally oval-shaped palette 110 having approximate dimensions of 12 inches by 16 inches. The exemplary palette 110 is made by Master's Touch, and may be available from retailers such as Hobby Lobby.

Figure 10:
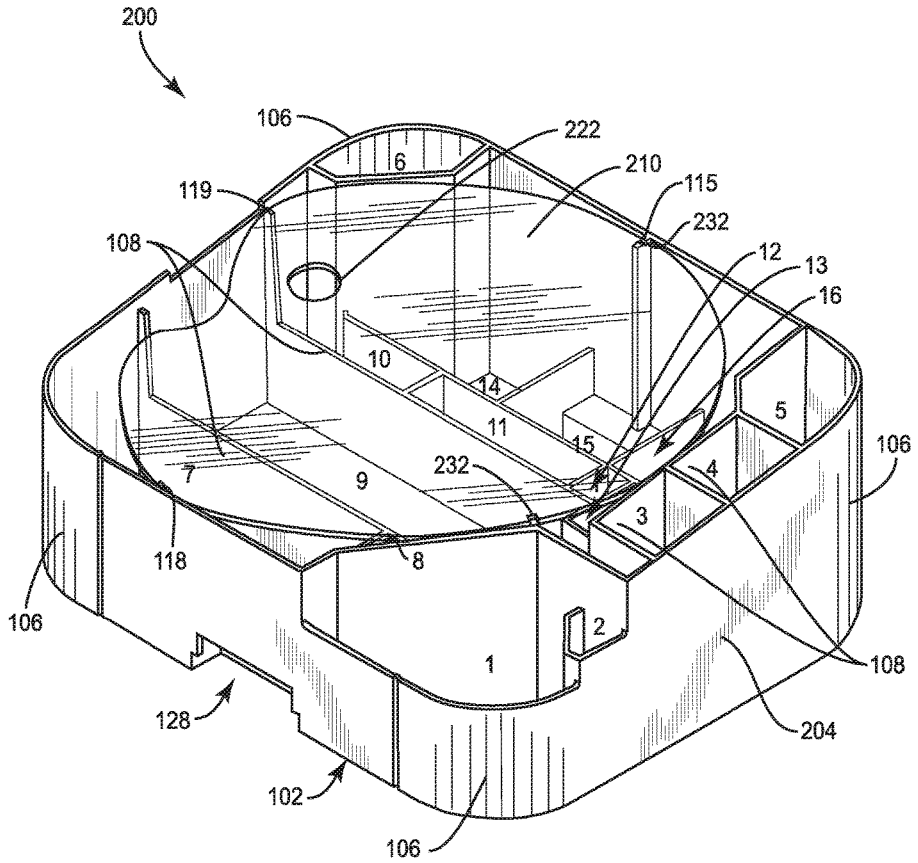
FIG. 10 shows a perspective view of a container according to other embodiments of the present disclosure.

In another embodiment, shown in FIGS. 10 and 11, a custom palette 210 has been created to reversibly engage with a container 200 having a peripheral wall 204 having a second configuration.

The containers 100, 200 may be configured to support the respective palettes 110, 210 at an incline relative to the reference surface or the bottom wall 102. As best seen in FIGS. 2 and 11, the container 100, 200 includes a plurality of support posts (labeled 115-119). The tops of each support post 115-119 collectively define a support plane S. In one embodiment, the plurality of support posts 115-119 extend to different heights relative to the bottom wall 102. Depending upon the relative position of the support posts 115-119 each post may or may not have the same relative height. In the case of the embodiment shown in FIGS. 1-9, each support post 115-119 has a unique height.

Figure 6:
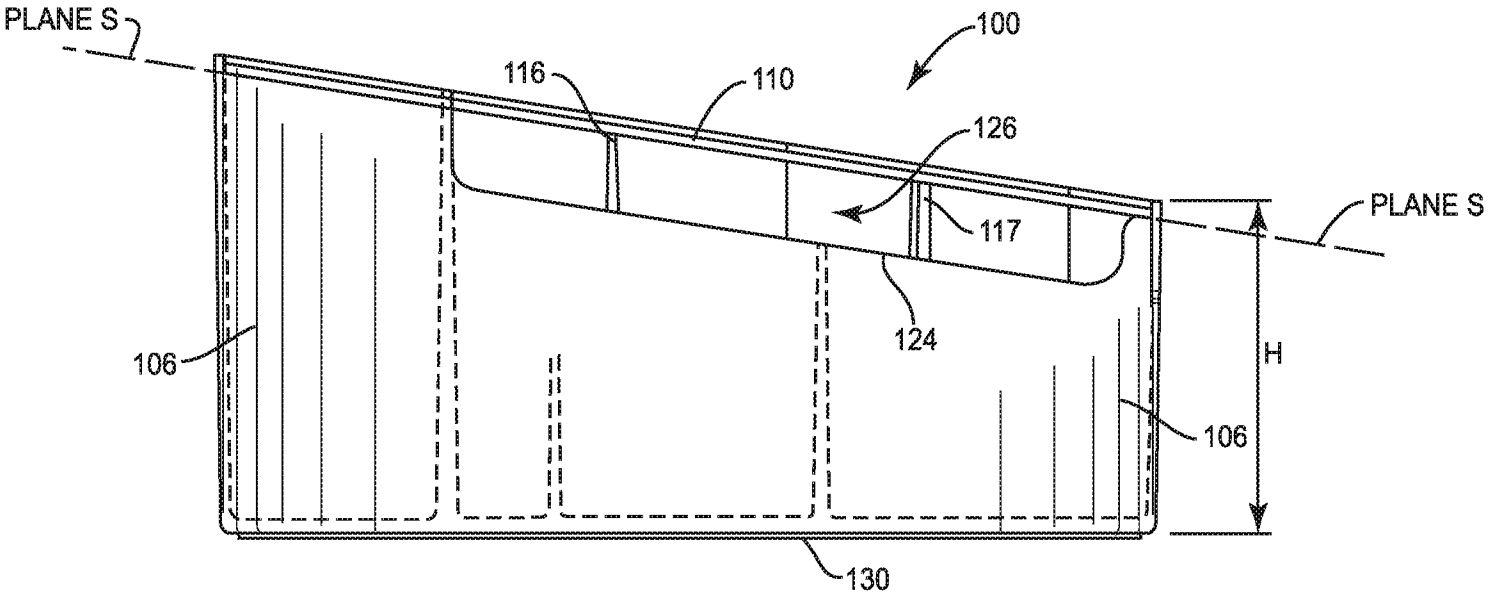
FIG. 6 shows a left side view of the container shown in FIG. 1.
Figure 7:
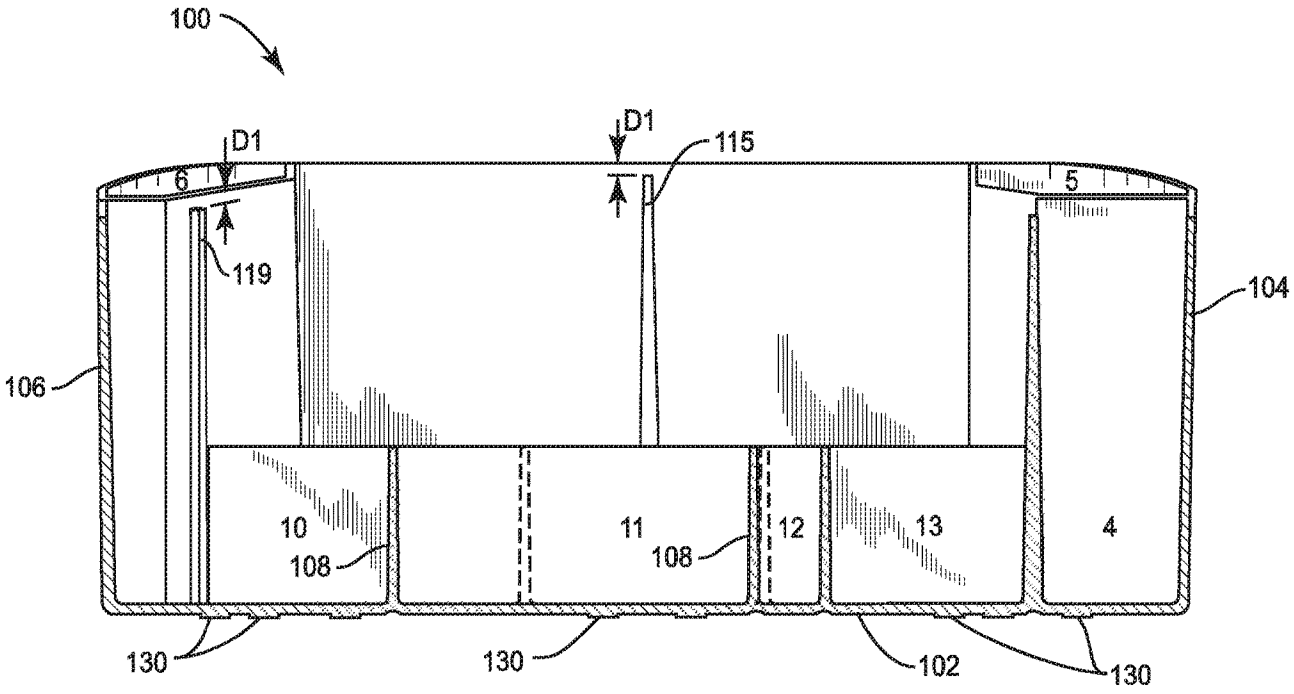
FIG. 7 shows a longitudinal section view taken along line 7-7 shown in FIG. 1.
Figure 8:
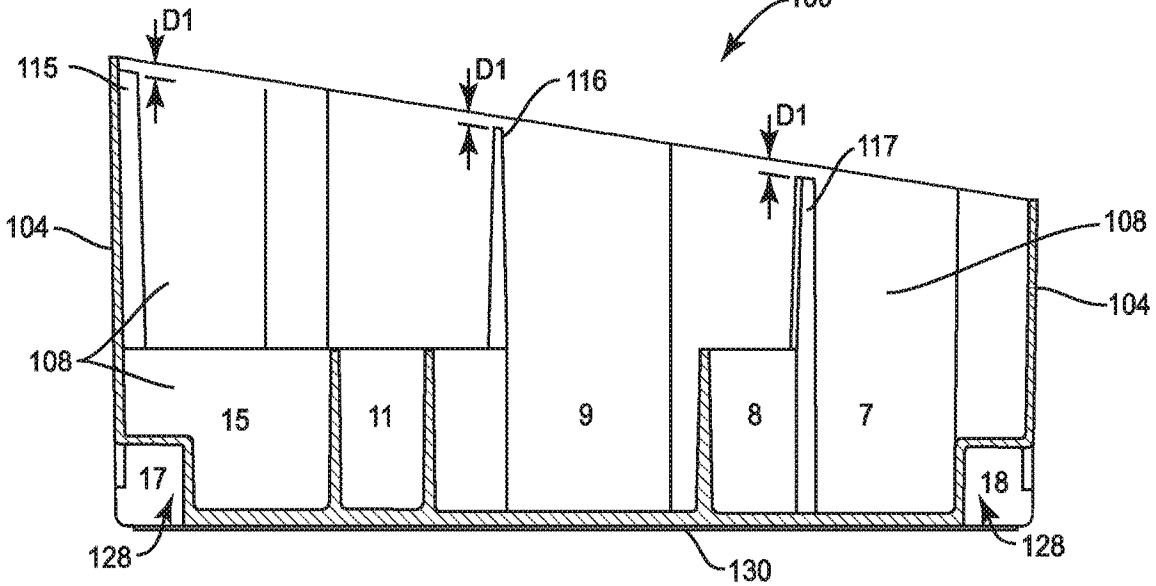
FIG. 8 shows a cross section view through another portion of the container taken along line 8-8 shown in FIG. 1.
Figure 9:
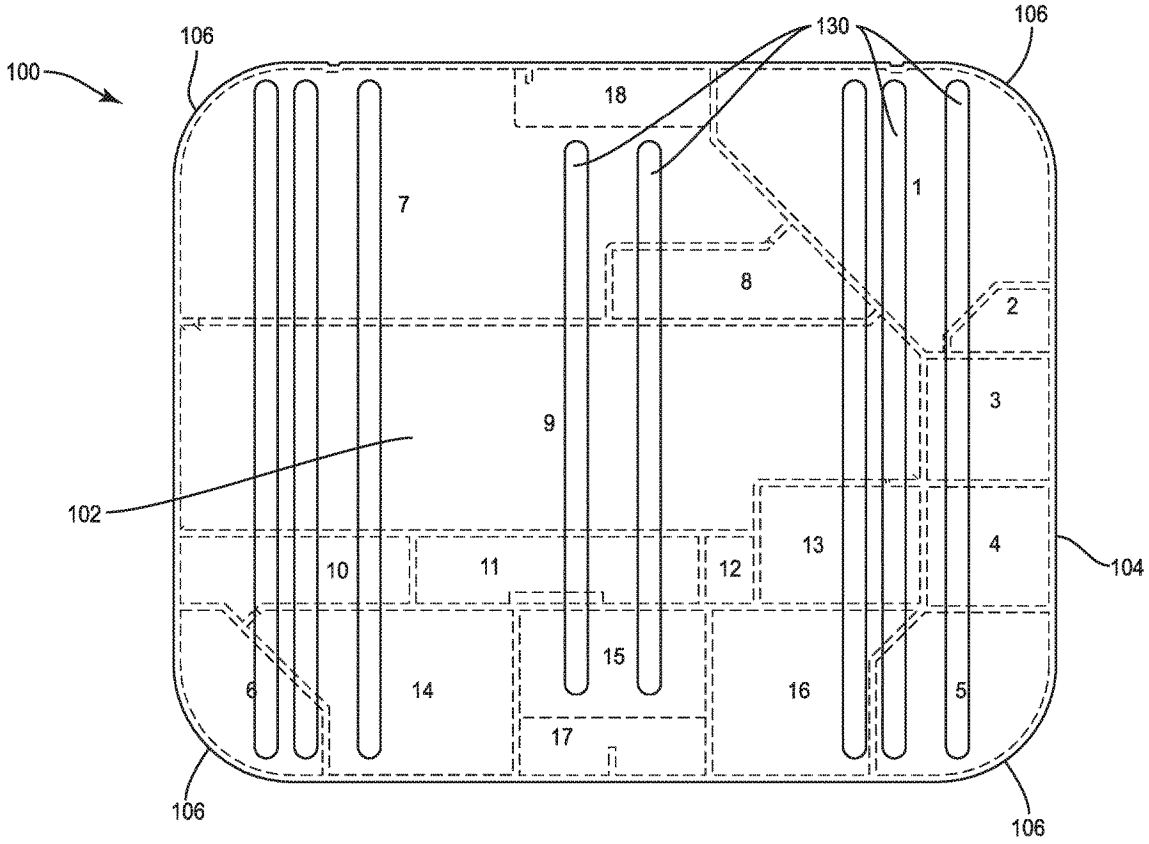
FIG. 9 shows a bottom view of the container shown in FIG. 1.

While each support post 115-119 may have a unique height relative to the bottom wall 102, the height of each post should be selected with respect to the other points in order to enable the top of each post to lie within the support plane S (see FIG. 6). Further, in at least one embodiment, the varied heights of the support posts define the support plane S such that the support plane is inclined relative to the bottom wall 102 (i.e., the reference plane). The support plane S may be inclined by between about 5 degrees and about 20 degrees relative to the bottom wall 102. Preferably, the support plane S may be inclined by about 9 degrees relative to the bottom wall 102. The preferred angle of inclination generally mimics the angle a palette naturally assumes when in-use within the hand/arm of many painters. As should be understood, a palette 110, 210 resting upon the plurality of support posts 115-119 is a palette lying in a plane generally corresponding to the support plane S, such that the palette held by the container 100, 200 will be provided at an angle relative to the bottom wall 102, which can be assumed to be horizontally supported.

Again, the support posts 115-119 are configured to support a predetermined palette 110, 210. In some embodiments, all of the support posts 115-119 will be in-use when the palette 110, 210 is placed within the container 100, 200. In other embodiments, less than all of the support posts 115-119 may be in-use when the predetermined palette is supported within the container. For example, a support post may not be in use, because its position corresponds to a cutout 122, 222 (FIGS. 2 and 11) in the oval shape of the palette 110, 210. Preferably, the support posts 115-119 and the container 100, 200 are configured so that the palette 110, 210 may be reversibly supported within the container 100, 200. In the case of reversibly supporting the palette, an unused support post may become an in-use support post depending on the side of the palette being supported. By being capable of supporting the palette 110, 210 with each side facing upward, the painter may be able to place the palette wet-paint-side down when they are finished painting. Placing the palette 110, 210 wet-paint-side down can keep the exposed surface of the palette clear, can help protect against accidental paint soiling and can facilitate the intact transport of in-use paint mixes for later frozen storage or disposal.

In some embodiments, the support posts 115-119 are positioned relative to the footprint of the container so that at least some of the support posts are positioned to support the palette near the edges thereof. In the illustrated embodiment, each of the support posts 115-119 is positioned adjacent to an edge of the palette 110, 210 in the seated orientation shown.

Figure 5:
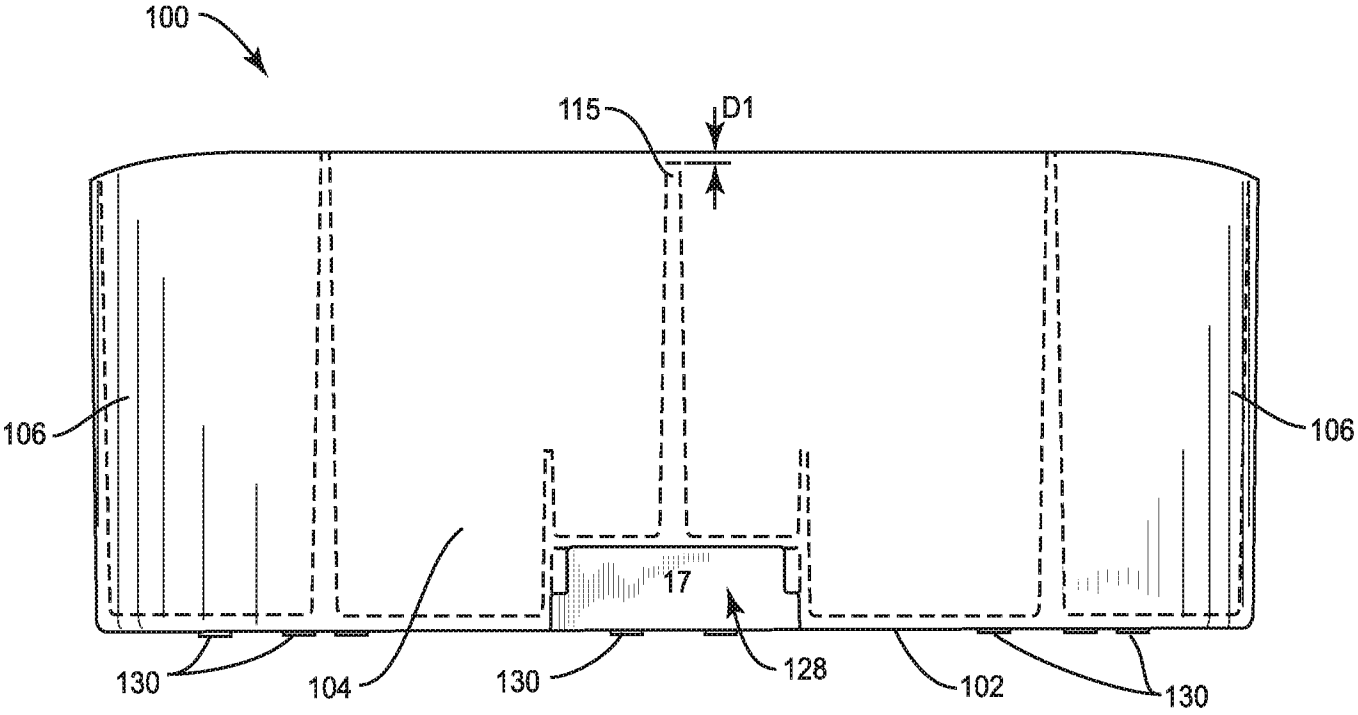
FIG. 5 shows a rear view of the container shown in FIG. 1.

While the support posts 115-119 are configured to be under the palette 110, 210 to support its weight, the container 100, 200 also may be configured to substantially prevent motion of palette 110, 210 along, or parallel to, the support plane S. Restraint of the palette 110, 210 in directions along the support plane S may be provided by portions of the peripheral wall 104, 204, portions of the one or more interior walls 108, or both, that extend to heights above the top of a respective support post. As seen in FIG. 5, a portion of the peripheral wall 104 extends slightly above the top of the support post 115 by a first distance D1 to form palette retention steps. The first distance in the example is 0.1875 inches. This first distance D can be between one and three times the thickness of the palette 110. In other words, the first distance D1 may be approximately equal to the thickness of the palette or the first distance may be a few times thicker than the palette 110. Having the first distance D1 less than the thickness of the palette 110 may limit the security of the seating of the palette within the container 100. If the first distance D1 is too short, the palette 110 may be able to ride up and jump out of the adjacent portion of the peripheral wall 104 or the interior wall 108 when a force is applied to slide the palette. If the first distance D1 is greater than three times the thickness of the palette, the respective portions of the peripheral wall 104 or the interior walls 108 may limit the painter's ability to remove the palette 110 from the container 100, or may produce undesired obstructions to the painter's ability to make use of the palette while held by the container.

In the illustrated embodiment, the container 100, 200 is configured to hold and retain the palette 110, 210 with portions of the peripheral wall 104, 204 and portions of a plurality of interior walls 108. When supported on each of the support posts 115-119 (i.e., fully seated), portions of the palette 110 may extend beyond the footprint of the container 100 as shown in FIG. 2. As such, in some embodiments, it should be understood that when fully seated, the palette 110 is not completely surrounded by portions of the peripheral wall 104 or the one or more interior walls 108, but is restrained from lateral movement. In other embodiments, the palette 210 may rest substantially entirely within the footprint of the container 200 as shown in FIG. 11.

In some embodiments, one or more portions of the peripheral wall 104 may have their upper edges lying substantially within the support plane S so that a seated palette 110 may be supported by the support posts 115-119, as well as the top edge of select portions of the peripheral wall 104. In some embodiments, one or more portions of the peripheral wall 104 may have their upper edges 124 (FIG. 6) spaced below the support plane S to form a gap 126 between the upper edge 124 of the respective portions of the peripheral wall 104 and a seated palette 110. The gap 126 provides the artist with a slot into which they may place their hand to pick up the palette from the seated position.

When seated, the palette 110, 210 may function as a partial lid or cover for the container 100, 200. The seated palette may at least partially cover several of the storage compartments (see compartments 7-16 in FIGS. 2 and 11). The palette 110, 210 may leave several other storage compartments uncovered (see compartments 1-6 in FIGS. 2 and 11), particularly those disposed around portions of the periphery of the seated palette. Having one or more uncovered compartment when the palette 110, 210 is seated on the container 100, 200 provides access to those items the artist may need to access most often while painting. The interior walls 108 forming the covered storage compartments may terminate at heights well below the support plane S. In this configuration, there is extra space below the palette 110, 210 that may be used to store the items from the uncovered compartments during transportation of the container 100, 200 or during extended periods of non-use. Having a margin between the interior walls of the covered compartments and the support surface also will allow the palette to be seated wet-paint-side down without having the palette becoming stuck to the interior walls 108 as the paint dries.

The illustrated container 100, 200 includes a pair of external recesses 128 (FIGS. 1 and 10), for potential use as hand grips. The hand grips may be located on opposite sides of the container's footprint. The hand grips may be formed generally on the bottom of the container 100, 200 at the intersection of the bottom wall 102 and portions of the peripheral wall 104, 204.

While not illustrated in the accompanying figures, the container 100, 200 may include a neck strap. The ends of the neck strap may be so configured to be removably engageable with at least a portion of a respective hand-grip recess 128. In some embodiments, the length of the neck strap may be adjustable to support the container at a comfortable carrying height. The neck strap would then assist with the transportation of the container 100, 200.

The container 100, 200 according to the present disclosure may be made from any suitable material. Preferred materials include rigid polymers that are sufficiently strong to hold the artist's materials and tools without requiring an overly thick bottom wall 102 or an overly thick peripheral wall 104, 204. It is expected that the container 100, 200 should be configured to hold at least 10 lbs. of materials and equipment, but the container itself should be as light weight as possible. Structural ribs 130 may be included along portions of the peripheral wall 104, 204 or the bottom wall 102 to add stability to the container 100, 200. Any known method may be used to create the containers of the present disclosure. Common methods that may be suitable include molding or additive manufacturing (3D printing).

While not illustrated, the container 100, 200 according to the present disclosure may include a separate cover. The cover may be separable from the remainder of the container or may be attached along at least one side of the container by a hinge or other joint mechanism. When closed, the cover may present a top surface parallel with the bottom wall. Alternatively, when closed, the cover may present a top surface inclined relative to the bottom wall.

The container 200 of the present disclosure may form one element in an artist's kit. The kit may include a palette 210 of predetermined size and shape to fit securely within the container as discussed above. The palette 210 may be specially adapted for use with the container 200. Particularly, the palette 210 may include specially positioned markings or notches 232 that could align with one or more of the support posts 115-119 when the palette 210 is seated within the container 200. The markings may be etched indicia, grooves, tape or other similar markings. The notches 232 may assist the painter with the placement of the palette 210 into the container 210 by providing an indication of the proper orientation of the palette relative to the footprint. The palette 210 shown in FIG. 11 includes two notches 232. When the palette 210 is seated in the container 200 one of the notches 232 engages the support post 115. If the palette 210 is flipped over to have the opposite side facing upward, the other of the two notches 232 would be aligned to meet with the support notch 115. The kit according to the present disclosure may include one or more other materials or tools commonly used by artists, such as paint and brushes.

In other embodiments, the kit may include a towel and a fastener. The fastener may be used to removably couple the towel to a front portion of the peripheral wall, along the top edge thereof. The fastener may be a spring-load clip. When fastened to the container, the towel may hang down below the front of the container for convenient access by the artist for drying their brushes.

Although the above disclosure has been presented in the context of exemplary embodiments, it is to be understood that modifications and variations may be utilized without departing from the spirit and scope of the invention, as those skilled in the art will readily understand. Such modifications and variations are considered to be within the purview and scope of the appended claims and their equivalents.

The invention claimed is:

1. An artist's container, comprising:

a bottom wall;

a peripheral wall of non-uniform height surrounding the bottom wall, the peripheral wall defining a footprint of the container when viewed from the top;

one or more interior walls positioned within the footprint of the container to divide the interior into a plurality of storage compartments; and a plurality of support posts formed adjacent to the peripheral wall or the interior walls, wherein the plurality of support posts extend to varied heights above the bottom wall such that an imaginary support plane is defined by the tops of the plurality of support posts, the support plane being inclined relative to the bottom wall; and wherein at least some of the plurality of support posts are positioned within the footprint to support a painter's palette near the edges thereof.

2. The container of claim 1, wherein the footprint is generally rectangular with rounded corners.

3. The container of claim 1, wherein at least one of the one or more interior walls and at least a portion of the peripheral wall extends above the bottom wall to a height higher than the imaginary support plane by a first distance D1 to form palette retention steps.

4. The container of claim 3, wherein D1 is approximately equal to the thickness of the painter's palette.

5. The container of claim 1, wherein the container is configured such that portions of the painter's palette extend outside of the footprint when supported by the plurality of support posts.

6. The container of claim 5, wherein the peripheral wall is configured such that an access gap is formed between a top edge of a portion of the peripheral wall and the support plane at a location where the painter's palette would extend beyond the footprint.

7. The container of claim 1, wherein the container is configured such that the painter's palette is fully supported within the footprint of the container when supported by the plurality of support posts.

8. The container of claim 1, wherein the container further comprises at least one recess at the intersection of the bottom wall and the peripheral wall configured to provide handles for the container.

9. The container of claim 8, wherein the at least one recess is a pair of recesses positioned on opposite sides of the footprint.

10. The container of claim 9, further comprising a strap attached to the container at each of the pair of recesses, the strap configured to allow the container to hang around the artist's neck.

11. The container of claim 1, wherein a portion of the peripheral wall has an upper edge substantially corresponding to the support plane.

12. The container of claim 1, wherein the container is configured such that the painter's palette resting on each of the plurality of support posts is substantially restrained from movement in every direction along the support plane.

13. The container of claim 12, wherein the container is configured to restrain movement of the palette with at least one portion of the peripheral wall and at least one portion of the one or more interior walls.

14. The container of claim 1, wherein the container is so configured such that the painter's palette, when seated on the plurality of support posts, would at least partially cover at least one of the storage compartments and would not cover at least one of the storage compartments.

15. The container of claim 1, wherein at least some of the storage compartments have all dimensions between about 1.75 inches and 5.75 inches to accommodate one or more tubes of paint only in an upright position.

16. The container of claim 1, wherein the peripheral wall includes a plurality of ribs to increase structural stability of the container.

17. An artist's kit, comprising:

a container, comprising:

a bottom wall, a peripheral wall of non-uniform height surrounding the bottom wall, the peripheral wall defining a footprint of the container when viewed from the top, one or more interior walls positioned within the footprint of the container to divide the interior into a plurality of storage compartments, and a plurality of support posts formed adjacent to the peripheral wall or the interior walls; and a palette, wherein the plurality of support posts extend to varied heights above the bottom wall such that an imaginary support plane is defined by the tops of the plurality of support posts, the support plane being inclined relative to the bottom wall; and wherein at least some of the plurality of support posts are positioned within the footprint to support the palette near the edges thereof.

18. The artist's kit of claim 17, wherein the palette comprises notches to assist with seating the palette within the container.

19. The artist's kit of claim 17, wherein the palette, when resting on the support posts, lies substantially entirely within the footprint of the container.

20. An artist's container, comprising:

a bottom wall;

a peripheral wall surrounding the bottom wall, the peripheral wall defining a footprint of the container when viewed from the top;

one or more interior walls positioned within the footprint of the container to divide the interior into a plurality of storage compartments; and a plurality of support posts formed adjacent to the peripheral wall or the interior walls, wherein the plurality of support posts extend above the bottom wall within the footprint to support a painter's palette near the edges thereof, wherein the container is so configured such that the painter's palette, when seated on the plurality of support posts, would at least partially cover at least one of the storage compartments and would not cover at least one of the storage compartments such that the artist's container provides for storage, transport, and ready-to-use access for artist tools, materials and supplies.

* * * * *